US006447376B1

(12) United States Patent
Ohmori et al.

(10) Patent No.: US 6,447,376 B1
(45) Date of Patent: Sep. 10, 2002

(54) PLASMA DISCHARGE TRUING APPARATUS AND FINE-MACHINING METHODS USING THE APPARATUS

(75) Inventors: Hitoshi Ohmori; Yutaka Yamagata, both of Wako; Sei Moriyasu, Tokyo, all of (JP)

(73) Assignee: Riken, Wako (JP)

( * ) Notice: Subject to any disclaimer, the term of this patent is extended or adjusted under 35 U.S.C. 154(b) by 0 days.

(21) Appl. No.: 09/518,212

(22) Filed: Mar. 3, 2000

(30) Foreign Application Priority Data

Mar. 3, 1999 (JP) ..... 11-055907

(51) Int. Cl.[7] ..... B24B 53/00
(52) U.S. Cl. ..... 451/72; 451/443
(58) Field of Search ..... 451/443, 72, 56; 125/2, 11.01

(56) References Cited

FOREIGN PATENT DOCUMENTS

| | | | | |
|---|---|---|---|---|
| JP | 63-283861 | * 11/1988 | ..... | 125/11.01 |
| JP | 4-53677 | * 2/1992 | ..... | 125/11.01 |
| JP | 5-277937 | * 10/1993 | ..... | 125/11.01 |
| JP | 6-114732 | * 4/1994 | ..... | 125/11.01 |
| JP | 6-114733 | * 4/1994 | ..... | 125/11.01 |

* cited by examiner

*Primary Examiner*—Robert A. Rose
(74) *Attorney, Agent, or Firm*—Griffin & Szipl, P.C.

(57) ABSTRACT

A conductive grindstone 12, a circular disk-like discharge electrode 14 with an outer rim 14*a* that can access a machining surface 12*a* of the grindstone, an electrode rotating device 16, a position controlling device 18 that controls the relative position between the outer rim of the electrode and the grindstone, a voltage applying device 20 for applying voltage pulses between the grindstone and the electrode, and a mist-supplying device 22 that supplies pressurized conductive mist between the grindstone and the electrode are provided. The pressurized conductive mist is a mixture of a low-conductivity aqueous solution and compressed air. A plasma discharge is generated between the grindstone and the electrode by means of this pressurized conductive mist, and the grindstone is subjected to truing. In this way, grindstone essentricity and deflection can efficiently be removed, the grindstone does not deform, high-accuracy truing is achieved, the power supply can be compact with a small power output, no complicated control circuit or control device is needed, and consumable parts such as the electrode can easily be manufactured and remachined.

3 Claims, 3 Drawing Sheets

Input voltages vs. critical gaps for discharge

Nominal input voltage vs. actual voltages (potential difference between electrodes)

Input voltages vs. erosion efficiencies

Accuracies (roundness) of grindstone after truing

PLASMA DISCHARGE TRUING APPARATUS AND FINE-MACHINING METHODS USING THE APPARATUS

This application claims priority of Japanese Patent Application No. 11-055907, filed Mar. 3, 1999, the entire disclosure of which is incorporated herein by reference.

BACKGROUND OF THE INVENTION

1. Technical Field of the Invention

The present invention relates to a machine-top plasma discharge truing apparatus that trues a conductive grindstone with a special shape such as an extremely fine or thin shape on the machine, and fine-machining methods using the apparatus.

2. Prior Art

As optical telecommunications systems and optical technologies have rapidly progressed, hard brittle materials such as fine ceramics, optical glass, optical crystals, and semiconductor monocrystals have been widely used. Therefore, a technology for efficiently, accurately slicing or otherwise shaping these hard brittle materials is strongly demanded in the industrial field.

Electrolytic in-process dressing grinding (ELID grinding for short) is attracting attention as a processing method that is particularly suitable for forming such hard brittle materials. In the ELID grinding method, a conductive grindstone with extremely small or thin diamond grains, is used, and the workpiece is ground while electrolytically dressing the grindstone. The features include high machining accuracy, high-quality surface in roughness, and easy processing of three-dimensional hard parts.

Even with a grindstone shaped specially for microscopically fine machining work for extremely fine or thin shapes etc., eccentricity or deflection can occur during manufacturing. Therefore, before the grindstone is applied to such precision machining as the ELID grinding, eccentricity or deflection thereof must be removed by truing.

However, with the metal bond grindstone used in ELID grinding, the hardness of the bonding material is so high that the grindstone cannot be trued efficiently by conventional methods. In addition, correction accuracies are limited, so conventional truing methods cannot be used easily. More explicitly, when a grindstone applied to a hard brittle material either is extremely small, extremely thin (for instance, a diameter of 1 mm or less, a thickness of 1 mm or less) or has a complex shape, if a tool contacts the grindstone during mechanical truing, the grindstone body deforms, therefore, it cannot be trued to a high accuracy, which poses a problem.

On the other hand, electric discharge machining is known in the prior art as a non-contact machining method. According to this machining method, the workpiece to be machined is placed opposite a machining electrode in an insulative processing solution, with a gap, and the workpiece is machined to remove excessive portions by repeating short pulsive arc discharges.

In this machining method, however, there are problems including (1) the shape of an electrode must be preadjusted according to a desired processing shape, (2) spacing between the electrode and the workpiece should be controlled precisely, (3) large pulse current must be supplied between the electrode and the workpiece, which requires a large and complicated power supply, and (4) the electrode must be replaced frequently because its shape alters due to consumption of it.

SUMMARY OF THE INVENTION

The present invention has been achieved to solve the aforementioned various problems. That is, an object of the present invention is to provide a plasma discharge truing apparatus that can efficiently remove eccentricity and deflection of a grindstone with a special shape such as an extremely small or thin shape, does not deform, can true a workpiece to a high accuracy, needs only a small-sized, small-output power supply, does not require a complicated control circuit or device, and uses consumable parts that are easy to manufacture and remachine, such as electrodes, and to provide fine machining methods using the apparatus.

The inventors of the present invention noted that contactless, highly efficient, and accurate truing can be achieved by rotating a circular disk-like electrode while generating uniform, high-efficiency sparks (plasma discharge) between the outer rim of the electrode and the grindstone, and also that the power supply can be made compact with a small output capacity, and variations of electrode shape can be greatly suppressed. In other words, the conductivity of a metal bond grindstone used in ELID grinding is used to generate a plasma discharge at a microscopic gap between the grindstone and the electrode, thereby a metal bond portion can be dissolved and removed without contact at a high accuracy, therefore, the surface of the grindstone can be modified into a preferred shape. The present invention is based on the above-mentioned knowledge.

In more detail, the present invention provides a plasma discharge truing apparatus with a conductive grindstone (12) for machining workpiece (1), a circular disk-like discharge electrode (14) whose outer rim **(14*a*) can access a surface (12*a*) to be machined by the aforementioned conductive grindstone, an electrode rotating device (16) that drives the above-mentioned discharge electrode to rotate around its shaft center Z, a position control device controlling a relative position between the outer rim of the electrode and the grindstone, a voltage applying device (20) for applying pulses of a predetermined voltage between the grindstone and the electrode, and a mist supplying device (22)** for supplying pressurized conductive mist between the grindstone and the electrode.

According to the above-mentioned configuration of the present invention, the aforementioned sparks (plasma discharge) can be generated stably between the outer rim of the rotating circular disk-like discharge electrode (14) and the machining surface **(12*a*) of the conductive grindstone (12) whose position is controlled by a position control device (18)**, thereby the metal bond portion of the conductive grindstone can be dissolved and removed highly efficiently and accurately, so the surface of the grindstone can be altered to a preferred shape.

Because the discharge electrode (14) rotates around shaft center Z by means of electrode rotating device (16), even if the electrode is consumed by a plasma discharge, the electrode can maintain a satisfactory roundness, even after it has worn by the plasma discharge, so that the electrode can be operated continuously for a long time.

In addition, a mist-supplying device (22) feeds pressurized conductive mist (more preferably, a mixture of slightly conductive aqueous solution and compressed air) between the grindstone and the electrode, therefore, compared to the case in a dry state or where an insulative liquid is directly supplied, the plasma discharge can be generated stably with a higher current at a lower voltage, and the power supply can be made more compact with a smaller output power.

Furthermore, from an experiment, it was confirmed that when using the above-mentioned pressurized conductive mist, efficiency and accuracy of truing can be raised.

The present invention also provides a fine machining method with a plasma discharge truing process (A) wherein a circular disk-like discharge electrode (14) provided with an outer rim (14*a*) capable of accessing the surface (12*a*) to be machined by a conductive grindstone (12), and an electrode rotating device (16) that drives the aforementioned discharge electrode to rotate around a shaft center Z are provided, and while supplying a pressurized conductive mist between the grindstone and the electrode, DC voltage pulses are applied between the conductive grindstone and the discharge electrode, and the workpiece surface is shaped by the discharge; an electrolytic dressing process (B) wherein a dressing electrode (28) with an opposed surface (28*a*) separated from the machining surface of the above-mentioned conductive grindstone (12), and while supplying a conductive liquid between the grindstone and the dressing electrode, a DC voltage is applied between the conductive grindstone and the dressing electrode, and the conductive grindstone is dressed by electrolysis; and a grinding process (C) wherein the conductive grindstone machines the workpiece.

According to the methods of the present invention, a conductive grindstone with a special shape such as an extremely fine or thin shape, whose essentricity and deflection are removed by the plasma discharge truing process (A), is used to perform an electrolytic dressing process (B) and a grinding process (C) on the same machine either simultaneously or repeatedly, so that adverse effects of essentricity or deflection can be prevented, together with removing positioning errors that may occur during reinstallation of a workpiece etc., therefore, a hard brittle material can be machined highly efficiently and accurately.

Moreover, since pressurized conductive mist is supplied for discharge truing, as described above, the efficiency and the accuracy of truing can also be raised.

Other objects and advantages of the present invention are revealed through the following description referring to the attached drawings.

DESCRIPTION OF PREFERRED EMBODIMENTS

Figure 1:
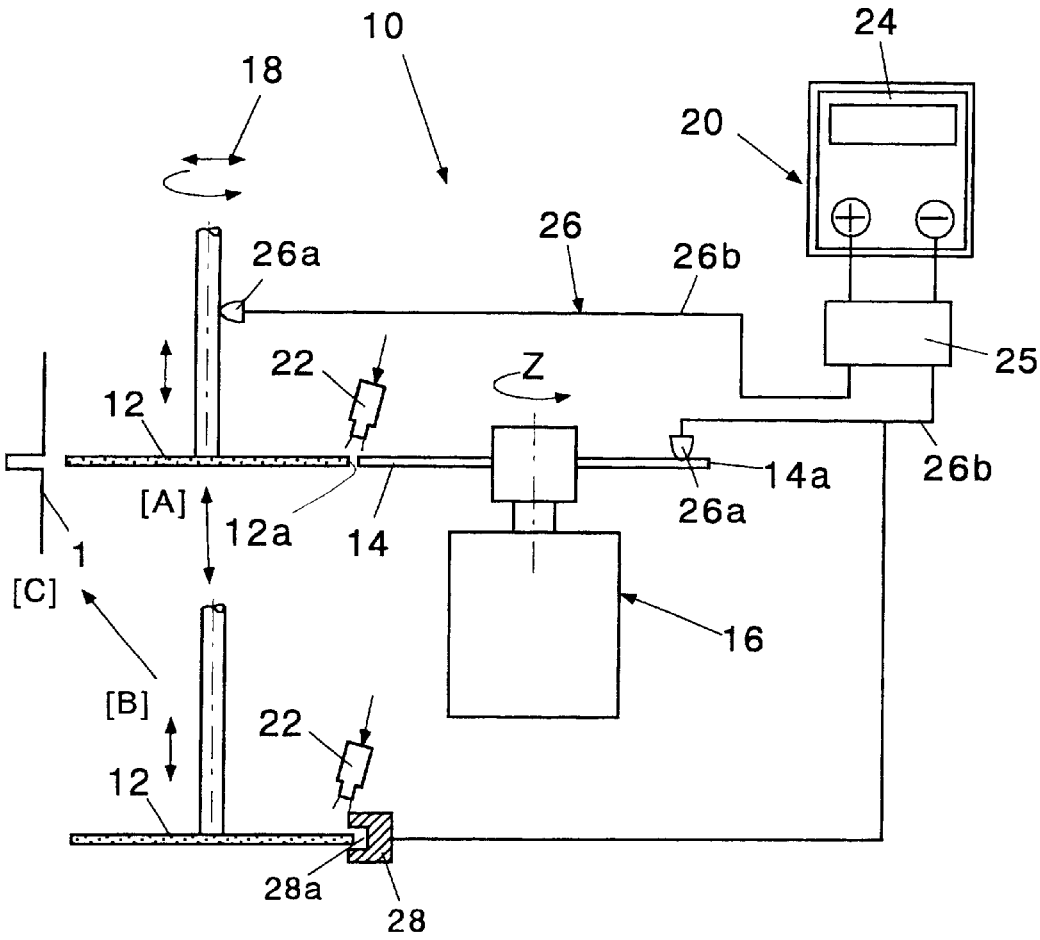
FIG. 1 is a general view of the configuration of a plasma discharge truing apparatus according to the present invention.

Preferred embodiments of the present invention are described below referring to the drawings. Common portions in each drawing are numbered identically, and no duplicate description is given here.

FIG. 1 is a general view of the configuration of a plasma discharge truing apparatus according to the present invention. As shown in FIG. 1, plasma discharge truing apparatus 10 of the invention is provided with a conductive grindstone 12, a circular disk-like discharge electrode 14, an electrode rotating device 16, a position control device 18, voltage applying device 20, and a mist-supplying device 22.

Conductive grindstone 12 is, in this example, a metal bond grindstone using fine diameter grains. The grindstone 12 can groove or slice or form workpiece 1 to be machined when the grindstone travels to the left in FIG. 1. This conductive grindstone 12 is also driven and rotated around its shaft center. the position control device 18 controls the relative position between outer rim 14*a* of electrode 14 and grindstone 12.

The thickness of the metal bond grindstone can be a free value, for instance, 1 mm or less. Conductive grindstone 12 can also be an extremely small metal bond grindstone.

Circular disk-like discharge electrode 14 is provided with outer rim 14*a* that can access machining surface 12*a* of conductive grindstone 12 (sharp-edged grindstone). Outer rim 14*a* of discharge electrode 14 is formed into a complete circle with the center of shaft center Z thereof. The thickness of this discharge electrode 14 should be as small as possible provided true roundness can be maintained, so that stabilized plasma discharge is achieved, for example, a thickness of 2 mm or less is preferred.

Discharge electrode 14 is mounted on the rotating shaft of electrode rotating device 16 (for example, a motor), and can be driven and rotated around the center of its shaft center Z.

Voltage applying device 20 is configured with a DC power supply 24, a pulse discharge circuit 25, and a current feeding line 26. DC power supply 24 generates a predetermined DC voltage (for instance, DC 60V~100V), which is applied to the input terminals of the pulse discharge circuit 25. Current feeding line 26 is composed of brushes 26*a* (current feeding means) sliding on and contacting the rotating shaft of grindstone 12 and the surface of discharge electrode 14, and connection lines 26*b* for electrically connecting brushes 26*a* and output terminals of pulse discharge circuit 25. The positive side of the output terminals is connected to the grindstone, and the negative side thereof is connected to the electrode.

Mist-supplying device 22 supplies pressurized conductive mist between grindstone 12 and electrode 14. This pressurized conductive mist should preferably be, for instance, a mixture of a water-soluble grinding fluid and compressed air, used in ELID grinding. This fluid is not a complete insulative liquid, but is electrically conductive to some extent (for example, 1300~180 $\mu$S/cm. More preferably, it should be a weak conductive aqueous solution having a function for reducing electrical resistance between grindstone 12 and electrode 14.

Figure 2:
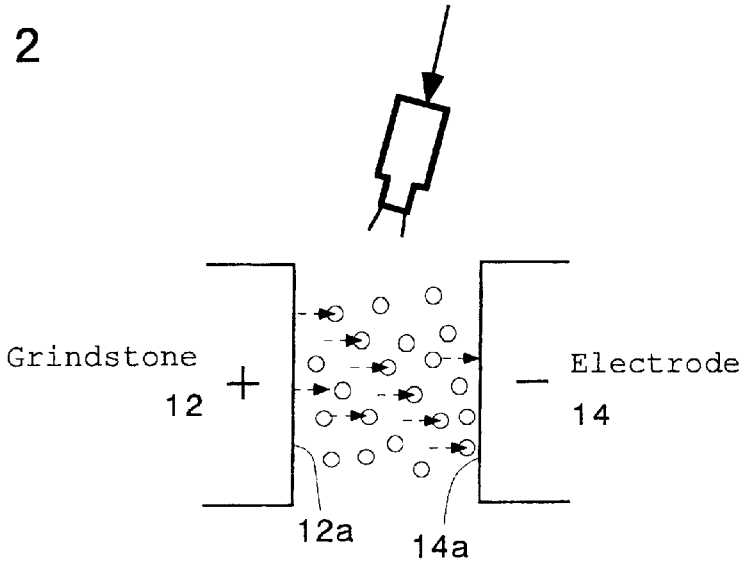
FIG. 2 shows the principles of plasma discharge.

FIG. 2 shows principles of plasma discharge. In FIG. 2, when grindstone 12 and electrode 14 are charged with positive and negative potentials, respectively, metal portion 12*a* of the grindstone is ionized, and ions are isolated at a high efficiency in a plasma state. When there are conductive mist particles between grindstone 12 and electrode 14 in this state, the route of the current there-between tends to be kept stable, so discharge phenomena are stabilized. As a result, a high-energy condition is established, wherein the temperature between the electrodes can easily increase, therefore, the efficiency of truing sharply rises, and discharge truing takes place as the plasma state occurs.

In the configuration of the plasma discharge truing apparatus 10 shown in FIG. 1, the discharge electrode 14 is rotated at a predetermined peripheral speed. The grindstone 12 is also rotated at another predetermined peripheral speed. The grindstone 12 is reciprocated in the axial direction by means of position control device 18 and fed in the radial direction at the same time at a predetermined speed. A predetermined gap is maintained between the grindstone 12 and the electrode 14, pressurized conductive mist is fed into the gap, stabilized discharge sparks are produced, and plasma discharge truing is carried out.

According to the aforementioned configuration of the present invention, the voltage-applying device 20 stably generates sparks (plasma discharge) between the outer rim 14*a* of the discharge electrode 14 and the machining surface 12*a* of the conductive grindstone 12, whose position is controlled by the position controlling device 18. When the electrode is rotating, a metal bond portion of the conductive grindstone 12 is dissolved and removed in a contactless, highly efficient, and highly accurate way, therefore, the surface of the grindstone can be altered to the preferred shape.

In addition, because the discharge electrode 14 is rotating around the shaft center Z by means of the electrode rotating device 16, the roundness of the electrode can be maintained, even after it is consumed by the plasma discharge, so the electrode can be operated continuously for a long time.

Furthermore, pressurized conductive mist is supplied between the grindstone and the electrode by the mist-supplying device 22, therefore, compared to the case in a dry state or another when an insulative liquid is supplied, a plasma discharge can be stably generated at a lower voltage with a larger current. As a result, the power supply can be made more compact with a smaller output power.

[Embodiments]

Embodiments of the present invention are described below.

As shown in FIG. 1, plasma discharge truing apparatus of the present invention is configured with a DC pulse power supply (voltage applying device 20) and a circular disk-like discharge electrode 14 driven and rotated by a motor 16. This embodiment employs a reciprocal truing mode wherein the grindstone 12 is driven reciprocally in the axial direction, and the outer rims of the grindstone and the electrode overlap during truing.

Truing media used for discharge truing included (1) AFG-M (low-conductivity aqueous solution used for ELID grinding), (2) pressurized conductive mist produced from AFG-M using compressed air, and (3) pressurized air, and the results were compared with case (4) in which these media were not used, that is, there was only an air gap.

According to the fundamental theory of electrochemistry, the electric machining mode in a system such as that described above accompanies mutual actions of a truing grindstone, an electrode, and operating media. In addition, the truing mechanism using a conductive aqueous solution (AFG-M) is explained as a complicated process in which various electric machining actions and reactions coexist. An object of the present invention for a plasma discharge truing apparatus and fine machining methods using the apparatus is to provide a truing process for a particular machining purpose, therefore, the invention can also be understood as a system for optimizing the efficiency of electric truing by controlling the mechanism thereof. Consequently, the invention can be applied also to similar types of tool.

(Process Characteristics)

To study process characteristics, the above-mentioned truing system was installed on a vertical machining center, and various tests were performed. In the tests, a cast iron bond diamond grindstone #2000 of 1 mm in thickness and 150 mm in diameter was trued. During the tests, the grindstone was rotated at 200 rpm, reciprocated in the Z direction at 100 mm/min, and simultaneously the truing electrode was rotated at 100 rpm.

(Critical Gap for Discharge)

Figure 3:
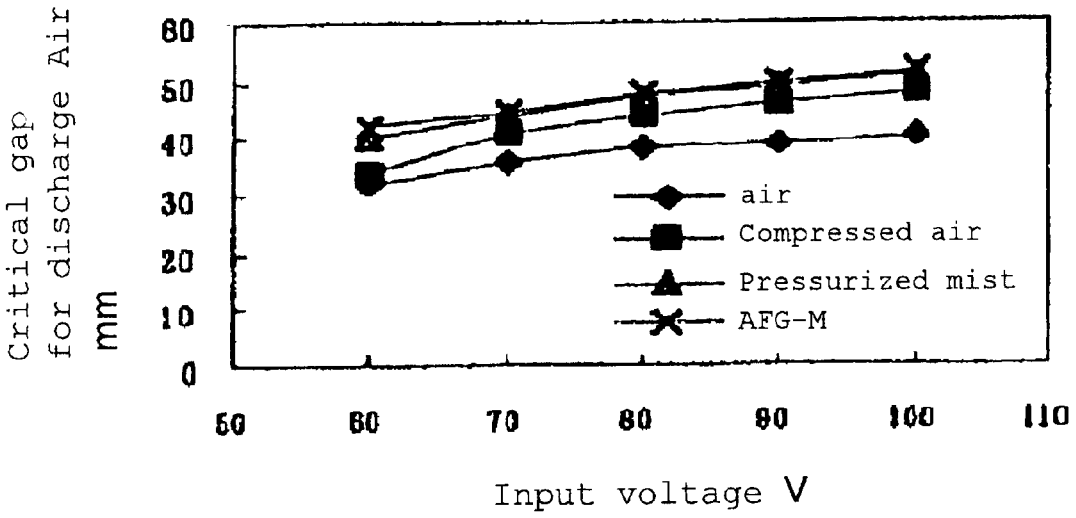
FIG. 3 is a view comparing critical discharge gaps.

FIG. 3 shows critical gaps for discharges with four types of operating media, that is, air, AFG-M, pressurized mist, and compressed air. Obviously, the gaps are, from small to large, $g_{air}<g_{pair}<g_{mist}<g_{AFG}$.

(Voltage Drop)

Figure 4:
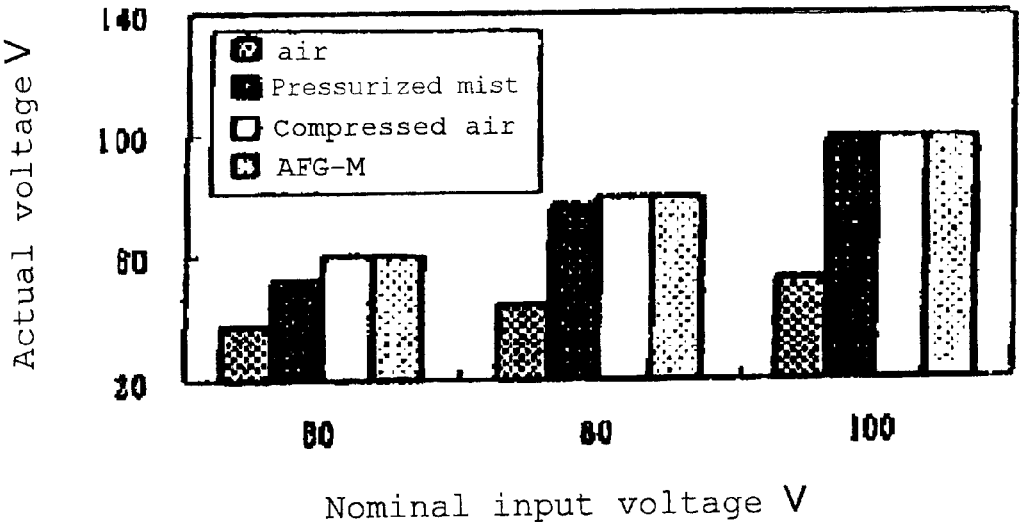
FIG. 4 compares actual input voltages.

FIG. 4 is a graph showing working voltages with the four operating media under the same conditions. Greater voltage drops are for truing using AFG-M and pressurized mist. This might be because another electric machining action of any type may occur at the same time.

(Truing Efficiency)

Figure 5:
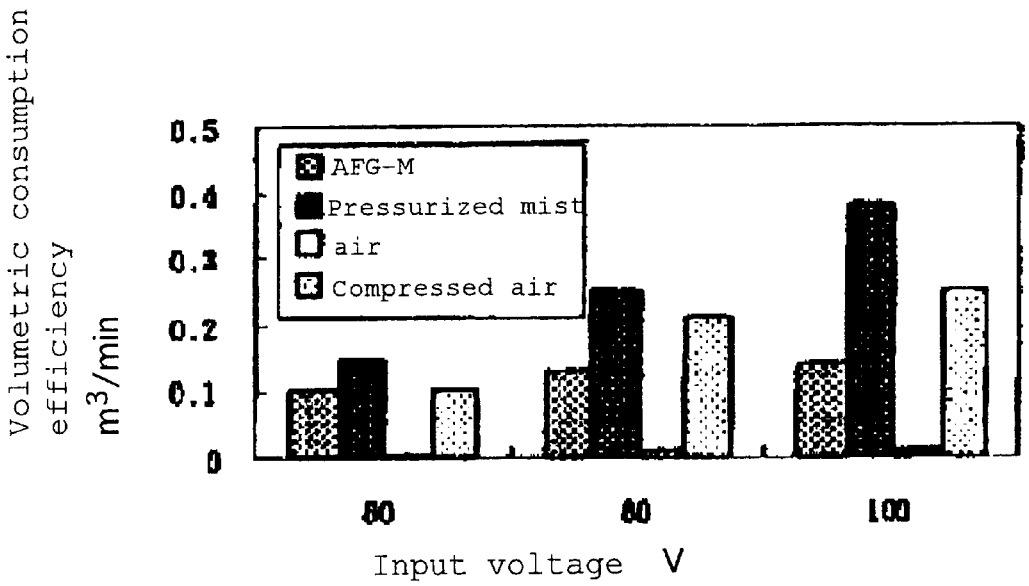
FIG. 5 shows the relationship between input voltages and truing efficiencies.

FIG. 5 illustrates the relationship between input voltages and truing efficiencies using the four operating media under the same conditions. The gap between the grindstone and the electrode was set at a constant value of 30 $\mu$m. Test results clearly show that with all four operating media, as the input voltage was increased, truing efficiency also increased. In addition, truing efficiencies when pressurized mist, compressed air, and AFG-M operating media were used, were large to small in that order, and all efficiencies were much higher than the efficiency when using air, and this tendency was more significant as input voltage was increased.

(Truing Accuracy)

Figure 6:
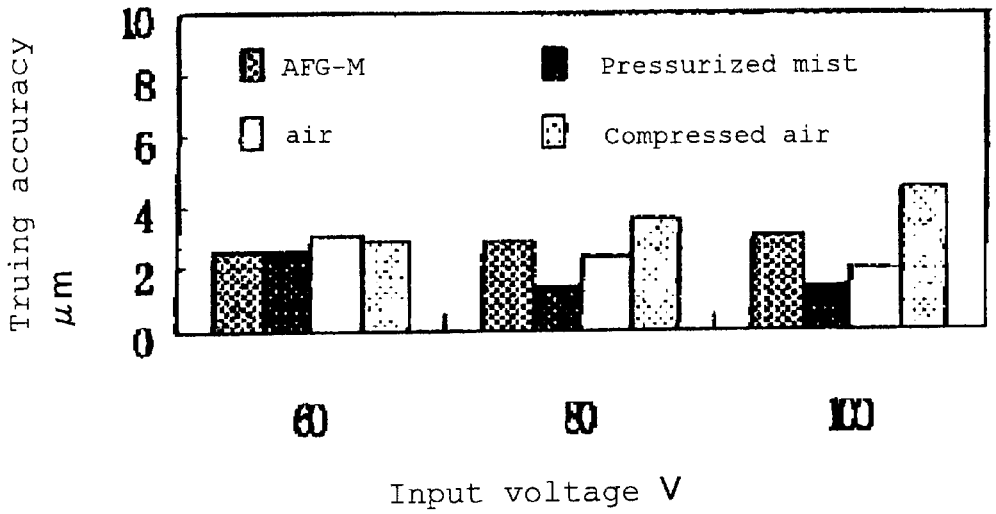
FIG. 6 compares truing accuracies.

FIG. 6 shows truing accuracies with the four operating media. The truing accuracy using pressurized mist as an operating medium is the highest, and the other operating media can obviously also achieve similar accuracies.

According to the present invention, it was confirmed that the machining accuracy required for ELID grinding could be assured by employing plasma discharge truing as a means of electric truing, and performing fine truing of the metal bond grindstone used in microscopic grinding work, in a precise way.

In addition, the following advantages were also proved to be available by applying the above-mentioned plasma discharge truing.

1. A conductive bond grindstone such as a metal bond and resin-metal composite bond can be trued.

2. Because the electric truing method provides non-contact machining, a grindstone with a small diameter and thickness can be trued precisely.

3. Using an NC machine, a grindstone with a complicated surface shape can be trued.

4. Electric truing can remove deflection of a grindstone, as well as make even super-abrasive grains to come out of a bond portion. Thus a complicated surface shape can be ground precisely while maintaining the shape of the grindstone.

Hence, the plasma discharge truing apparatus according to the present invention and the methods for fine machining using the apparatus can efficiently remove eccentricity and deflection of an extremely small, thin grindstone, so that the grindstone can be trued highly accurately without deforming the grindstone, using a compact, small-output power supply, without needing a complicated control circuit or device, and consumable parts such as an electrode can easily be manufactured or reprocessed, which are excellent practical advantages.

Although the present invention has been explained referring to several preferred embodiments, it should be understood that the scope of rights covered by the present invention should not be limited only to these embodiments. Conversely, the scope of rights of the present invention should include all modifications, amendments, and similar matters included in the scope of the attached claims.

What is claimed is:

1. A plasma discharge truing apparatus comprising a conductive grindstone for processing a workpiece, a circular disk discharge electrode with an outer rim that can access a surface to be processed by the conductive grindstone, an electrode rotating device that drives and rotates the discharged electrode around shaft center Z thereof, a position controlling device for controlling the relative position between the outer rim of the electrode and the grindstone, a voltage applying device to apply predetermined voltage pulses between the grindstone and the electrode, and a mist-supplying device for supplying pressurized conductive mist between the grindstone and the electrode, wherein the pressurized conductive mist comprises a mixture of low-conductivity aqueous liquid and compressed air.

2. A fine-machining method, comprising:

(A) plasma discharge truing a conductive grindstone with a circular disk electrode having an outer rim that can access a surface to be processed of a conductive grindstone, and an electrode rotating device that drives and rotates the discharge electrode around shaft center Z thereof, wherein while a pressurized conductive mist is supplied between the grindstone and the electrode, DC voltage pulses are applied between the conductive grindstone and the discharge electrode, thereby trimming the surface to be processed, wherein said pressurized conductive mist comprises a mixture of low-conductivity aqueous solution and compressed air;

(B) electrolytically dressing the conductive grindstone with a dressing electrode having a surface opposite the surface to be processed on the conductive grindstone and having a spacing, said dressing achieved by supplying a conductive liquid between the grindstone and the pressing electrode while a DC voltage is applied between the conductive grindstone and the dressing electrode, whereby the conductive grindstone is electrolytically dressed; and (C) grinding a workpiece with the conductive grindstone.

3. A plasma discharge truing apparatus comprising a conductive grindstone for processing a workpiece, a circular disk discharge electrode with an outer rim that can access a surface to be processed by the conductive grindstone, an electrode rotating device that drives and rotates the discharged electrode around shaft center Z thereof, a position controlling device for controlling the relative position between the outer rim of the electrode and the grindstone, a voltage applying device to apply predetermined voltage pulses between the grindstone and the electrode, and a mist-supplying device for supplying pressurized conductive mist between the grindstone and the electrode, wherein the mist-supplying device supplies a mixture of low-conductivity aqueous liquid and compressed air.

* * * * *